US010730194B2

(12) United States Patent
Marble

(10) Patent No.: US 10,730,194 B2
(45) Date of Patent: Aug. 4, 2020

(54) SEWER'S MULTI-TOOL ASSEMBLY

(71) Applicant: Diana Jean Marble, Reseda, CA (US)

(72) Inventor: Diana Jean Marble, Reseda, CA (US)

( * ) Notice: Subject to any disclaimer, the term of this patent is extended or adjusted under 35 U.S.C. 154(b) by 0 days.

(21) Appl. No.: 16/242,578

(22) Filed: Jan. 8, 2019

(65) Prior Publication Data

US 2020/0215706 A1 Jul. 9, 2020

(51) Int. Cl.

| | |
|---|---|
| ***B26B 1/00*** | (2006.01) |
| ***B26B 13/22*** | (2006.01) |
| *B26B 29/04* | (2006.01) |
| *B26B 13/16* | (2006.01) |
| *B26B 13/06* | (2006.01) |

(52) U.S. Cl.

CPC ..... *B26B 13/22* (2013.01); *B26B 13/06* (2013.01); *B26B 13/16* (2013.01); *B26B 29/04* (2013.01)

(58) Field of Classification Search

CPC ..... B26B 13/22; B26B 13/16; B26B 29/04; B25B 7/02

See application file for complete search history.

(56) References Cited

U.S. PATENT DOCUMENTS

| | | | | |
|---|---|---|---|---|
| 1,021,863 A | | 4/1912 | Daniels | |
| 1,552,688 A | | 9/1925 | Fichtman | |
| 3,576,072 A | * | 4/1971 | Foster | A61B 17/30 606/138 |
| 4,709,481 A | * | 12/1987 | Moore | B26B 9/02 30/314 |
| 4,753,009 A | | 6/1988 | Haga | |
| 5,341,822 A | * | 8/1994 | Farr | A61F 15/02 128/898 |
| 5,353,505 A | * | 10/1994 | Okada | B26B 13/18 30/236 |
| 6,402,763 B1 | * | 6/2002 | Scott | A61B 17/50 30/155 |
| D460,334 S | | 7/2002 | Carpenter | |
| 6,592,603 B2 | * | 7/2003 | Lasner | A61B 17/2841 30/261 |
| 8,713,766 B2 | * | 5/2014 | Wiman | A41H 31/005 26/27 |
| 8,959,777 B2 | | 2/2015 | Forman | |
| 9,119,644 B2 | * | 9/2015 | Boettner | A61B 17/025 |
| 9,393,705 B2 | | 7/2016 | Schmithorst | |
| 2005/0034574 A1 | * | 2/2005 | Hsien | B25B 7/02 81/415 |
| 2005/0193569 A1 | * | 9/2005 | Hop | B26B 13/16 30/253 |

(Continued)

*Primary Examiner* — Omar Flores Sanchez

(57) ABSTRACT

A sewer's multi-tool assembly for performing multiple sewing tasks with a single tool includes a pair of scissors that is hingedly coupled together for cutting fabric. A pair of magnets is provided and each of the magnets is coupled to a respective one of the scissors. Each of the magnets magnetically engages a sewing machine when the scissors are positioned on the sewing machine. In this way the scissors are inhibited from falling off the sewing machine. A pair of grips is each coupled to a respective one of the scissors for transporting the object without cutting the object. Each of the grips is spaced apart from each other when the scissors are closed such that neither of the grips impedes the scissors from closing and thusly cutting. A seam ripper is coupled to a respective one of the grips for ripping seams.

6 Claims, 3 Drawing Sheets

(56) References Cited

U.S. PATENT DOCUMENTS

2005/0217118 A1* 10/2005 Mah ..... B25F 1/003 30/261
2005/0262704 A1* 12/2005 DiSanto ..... A41H 31/005 30/289
2006/0048391 A1* 3/2006 Bellissimo ..... B25B 7/02 30/134
2006/0075642 A1* 4/2006 Elkins ..... B26B 17/00 30/233
2006/0150418 A1* 7/2006 Hsieh ..... B25B 7/02 30/28
2006/0260135 A1* 11/2006 Khan-Sullman ... A61B 17/0467 30/134
2006/0266379 A1* 11/2006 Shelton ..... A45D 24/10 132/333
2007/0251100 A1* 11/2007 Fisk ..... D05B 89/00 30/253
2009/0019707 A1* 1/2009 Samuels ..... B26B 15/00 30/289
2009/0193666 A1* 8/2009 Lau ..... B26B 13/06 30/194
2013/0233135 A1* 9/2013 MacFarlane ..... B26D 3/167 83/13
2013/0319193 A1* 12/2013 Roche ..... B26B 3/00 83/13
2013/0327348 A1* 12/2013 Ashur ..... A45D 29/00 132/73.6
2014/0041491 A1 2/2014 Ying
2014/0101944 A1 4/2014 Moultrie
2014/0325846 A1* 11/2014 Hussain ..... B26B 13/06 30/29
2015/0128427 A1* 5/2015 Linn ..... B26B 13/16 30/260
2015/0283714 A1* 10/2015 Sandefur ..... B26B 15/00 30/210
2019/0308337 A1* 10/2019 Swanstrom ..... B26B 29/04

* cited by examiner

SEWER'S MULTI-TOOL ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to multi-tool devices and more particularly pertains to a new multi-tool device for performing multiple sewing tasks with a single tool.

BRIEF SUMMARY OF THE INVENTION

An embodiment of the disclosure meets the needs presented above by generally comprising a pair of scissors that is hingedly coupled together for cutting fabric. A pair of magnets is provided and each of the magnets is coupled to a respective one of the scissors. Each of the magnets magnetically engages a sewing machine when the scissors are positioned on the sewing machine. In this way the scissors are inhibited from falling off the sewing machine. A pair of grips is each coupled to a respective one of the scissors for transporting the object without cutting the object. Each of the grips is spaced apart from each other when the scissors are closed such that neither of the grips impedes the scissors from closing and thusly cutting. A seam ripper is coupled to a respective one of the grips for ripping seams.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
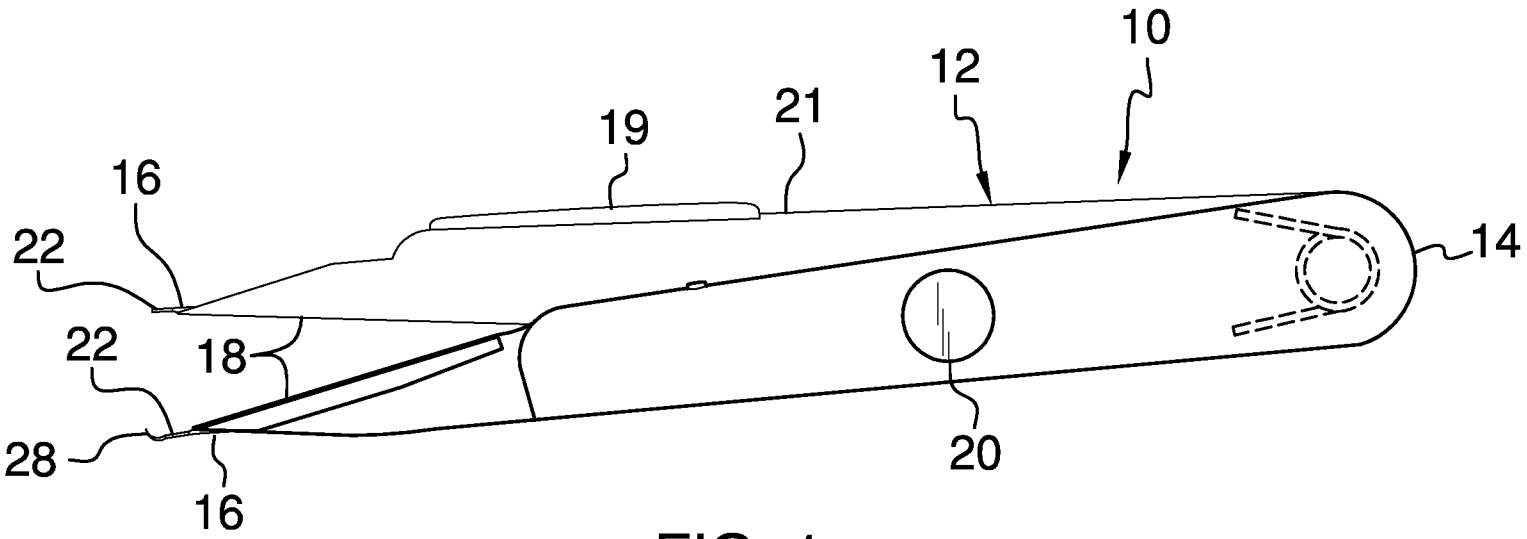
FIG. 1 is a right side view of a sewer's multi-tool assembly according to an embodiment of the disclosure showing a pair of scissors in an open position.
Figure 2:
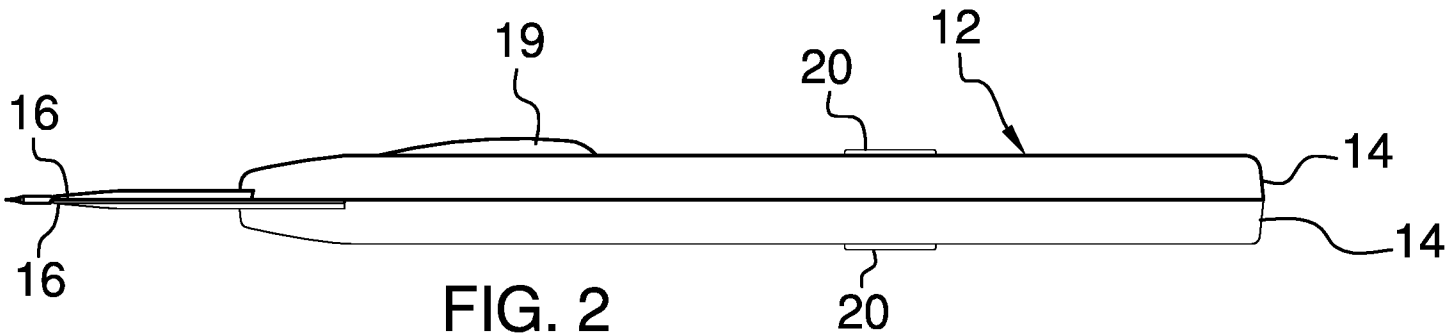
FIG. 2 is a top view of an embodiment of the disclosure.
Figure 3:
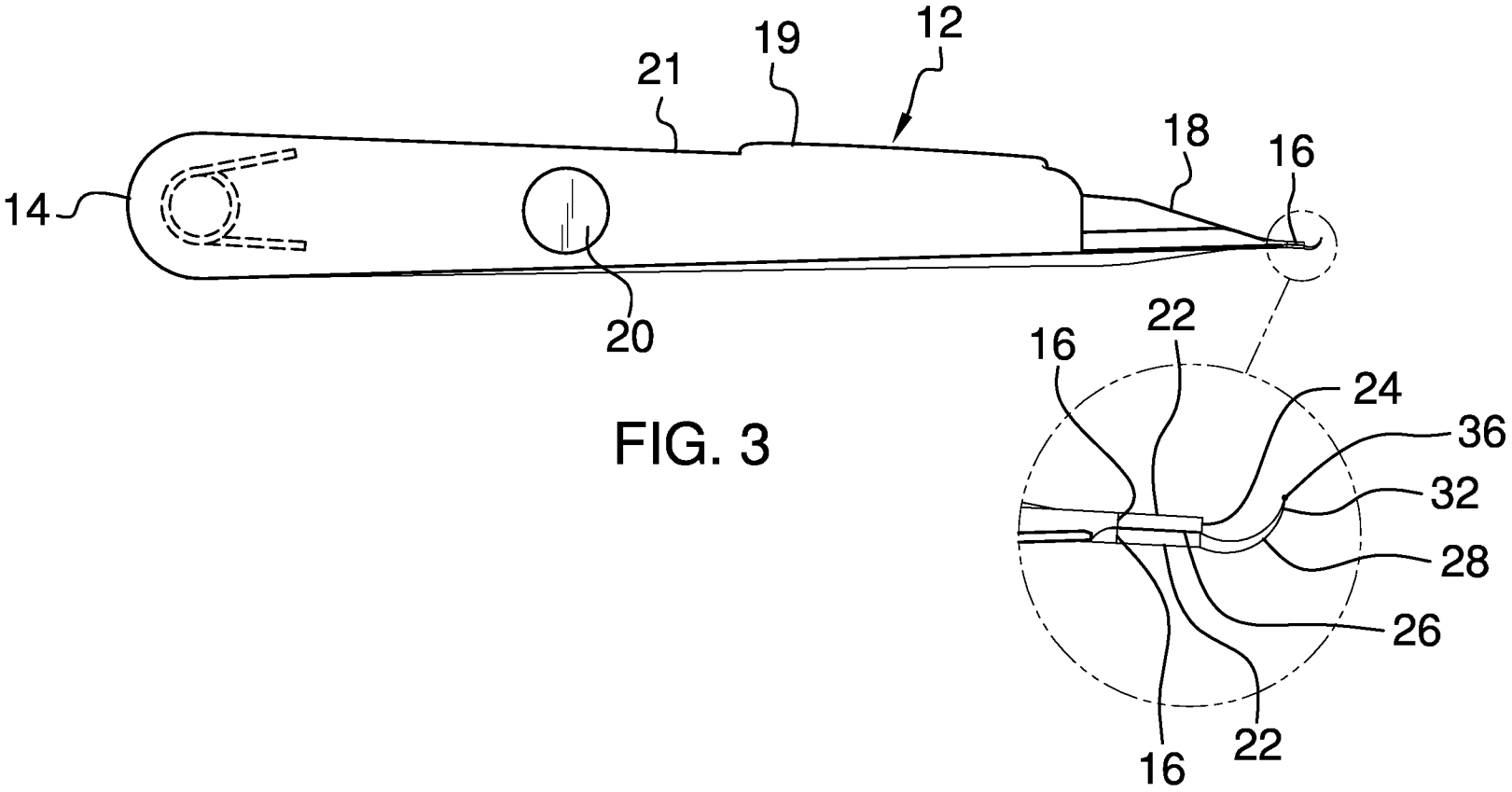
FIG. 3 is a right side view of an embodiment of the disclosure showing a pair of scissors in a closed position.
Figure 4:
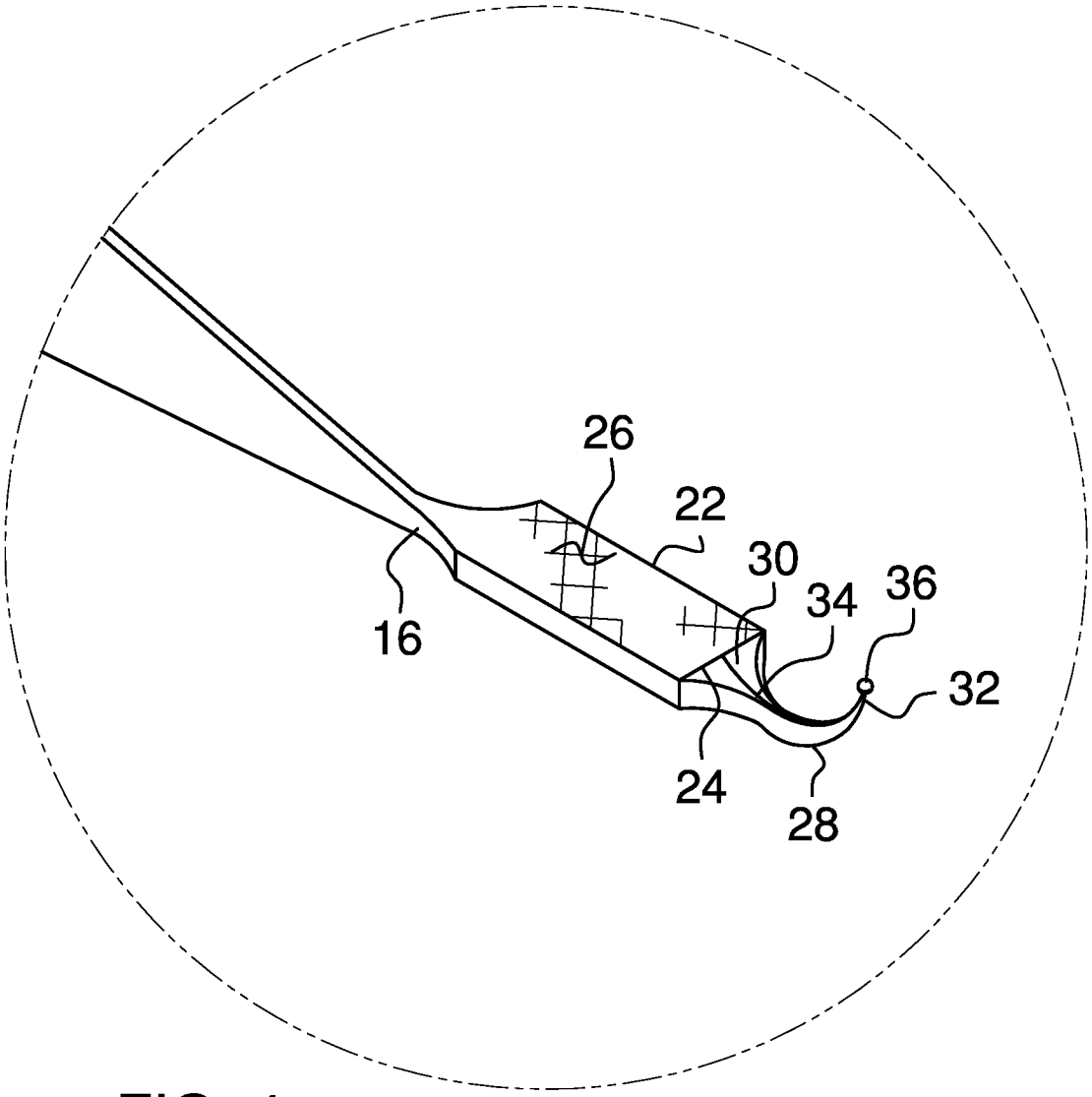
FIG. 4 is a detail view taken from circle 4 of FIG. 3 of an embodiment of the disclosure.

With reference now to the drawings, and in particular to FIGS. 1 through 4 thereof, a new multi-tool device embodying the principles and concepts of an embodiment of the disclosure and generally designated by the reference numeral 10 will be described.

As best illustrated in FIGS. 1 through 4, the sewer's multi-tool assembly 10 generally comprises a pair of scissors 12 that is hingedly coupled together for cutting fabric. Each of the scissors 12 has a first end 14 and a second end 16, and the first end 14 of each of the scissors 12 is pivotally coupled together having the second end 16 of each of the scissors 12 being aligned with each other. The second end 16 of each of the scissors 12 tapers to a point and the second end 16 of each of the scissors 12 is biased away from each other with a spring or the like. Each of the scissors 12 has a cutting edge 18 extending from the second end 16 toward the first end 14, and the cutting edge 18 on each of the scissors 12 engages each other when the scissors 12 are closed for cutting the fabric.

A thumb rest 19 is coupled to a top edge 21 of a respective one of the scissors 12 and the thumb rest 19 is engaged by a thumb to close the scissors 12 for cutting. A pair of magnets 20 is each coupled to a respective one of the scissors 12. Each of the magnets 20 magnetically engages a sewing machine when the scissors 12 are positioned on the sewing machine. Thus, the scissors 12 can be laid on the sewing machine without falling off of the sewing machine due to vibrations caused by operating the sewing machine. In this way the scissors 12 are constantly available to a sewer that is using the sewing machine.

A pair of grips 22 is each coupled to a respective one of the scissors 12. Each of the grips 22 frictionally engages an object when the scissors 12 are closed on the object. In this way the scissors 12 can transport the object without cutting the object. Moreover, each of the grips 22 is spaced apart from each other when the scissors 12 are closed. Thus, neither of the grips 22 impedes the scissors 12 from closing for the purposes of cutting.

Each of the grips 22 extends away from the second end 16 of the respective scissor, and each of the grips 22 has a distal end 24 with respect to the respective scissor and a top surface 26. The top surface 26 of each of the grips 22 may be textured to enhance gripping the object. The object may be a sewing needle, fabric, elastic or any other type of object common to sewing. Each of the grips 22 is oriented collinear with a longitudinal axis extending through the first 14 and second 16 ends of the respective scissor 12. The top surface 26 of each of the grips 22 faces each other and the object is compressed between the top surface 26 of each of the grips 22 when the scissors 12 are closed on the object. Moreover, the top surface 26 of each of the grips 22 is offset with the cutting edge 18 of the respective scissor 12. The top surface 26 of each of the grips 22 is spaced apart from each other when the scissors 12 are closed thereby facilitating the cutting edge 18 on each of the scissors 12 to engage each other for cutting.

A seam ripper 28 is coupled to a respective one of the grips 22 for ripping seams. The seam ripper 28 has an upper surface 30 and a distal end 32 with respect to the distal end 24 of the respective grip 22. Additionally, the upper surface 30 tapers to a point between the respective grip 22 and the distal end 32 of the seam ripper 28. In this way the distal end 32 of the seam ripper 28 can be easily inserted into a seam. The upper surface 30 is concavely arcuate between the respective grip 22 and the distal end 32 of the seam ripper 28 such that the seam ripper 28 curves toward the grip 22 to which the ream ripper 28 is opposed.

The upper surface 30 has a ridge 34 extending between the distal end 32 of the seam ripper 28 and the respective grip 22. The ridge 34 is sharpened thereby facilitating the ridge 34 to cut thread in the seam for ripping the seam. A ball 36 is coupled to the distal end 32 of the seam ripper 28. The ball 36 inhibits the distal end 32 of the seam ripper 28 from piercing the sewer's finger.

In use, the scissors 12 are placed on the sewing machine when the scissors 12 are not being used and the magnets 20 magnetically engage the sewing machine. In this way the scissors 12 will not fall on the floor when the sewing machine is turned on. The scissors 12 are manipulated to rip seams, grip objects or to cut fabric. In this way multiple tasks related to sewing can be accomplished with a single tool. Additionally, the scissors 12 are biased into an open position thereby facilitating the sewer to easily open and close the scissors 12 with one hand.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sewer's multi-tool assembly having a seam ripper being integrated into a pair of scissors wherein said assembly is configured to be manipulated by a sewer for cutting fabric and for ripping seams, said assembly comprising:

a pair of scissors being hingedly coupled together for cutting fabric, each of said scissors having a first end and a second end, said first end of each of said scissors being pivotally coupled together having said second end of each of said scissors being aligned with each other, said second end of each of said scissors tapering to a point, said second end of each of said scissors being biased away from each other, each of said scissors having a cutting edge extending from said second end toward said first end, said cutting edge on each of said scissors engaging each other when said scissors are closed for cutting the fabric;

a pair of magnets, each of said magnets being coupled to a respective one of said scissors, each of said magnets magnetically engaging a sewing machine when said scissors are positioned on the sewing machine wherein said magnets are configured to inhibit the scissors from falling off the sewing machine;

a pair of grips, each of said grips being coupled to a respective one of said scissors wherein each of said grips is configured to frictionally engage an object when said scissors are closed on the object for transporting the object without cutting the object, each of said grips being spaced apart from each other when said scissors are closed such that neither of said grips impedes said scissors from closing and thusly cutting; and a seam ripper being coupled to a respective one of said grips wherein said seam ripper is configured to rip seams.

2. The assembly according to claim 1, wherein:

each of said grips extends away from said second end of said respective scissor, each of said grips having a distal end with respect to said respective scissor and a top surface, each of said grips being oriented collinear with a longitudinal axis extending through said first and second ends of said respective scissor;

said top surface of each of said grips faces each other wherein said grips are configured to compress the object between said top surface of each of said grips when said scissors are closed on the object; and said top surface of each of said grips being offset with said cutting edge of said respective scissor, said top surface of each of said grips being spaced apart from each other when said scissors are closed thereby facilitating said cutting edge on each of said scissors to engage each other for cutting.

3. The assembly according to claim 1, wherein said seam ripper has an upper surface and a distal end with respect to a distal end of said respective grip, said upper surface tapering to a point between said respective grip and said distal end of said seam ripper wherein said seam ripper is configured to be inserted into a seam, said upper surface being concavely arcuate between said grip and said distal end of said seam ripper such that said seam ripper curves toward said grip to which said ream ripper is opposed.

4. A sewer's multi-tool assembly having a seam ripper being integrated into a pair of scissors wherein said assembly is configured to be manipulated by a sewer for cutting fabric and for ripping seams, said assembly comprising:

a pair of scissors being hingedly coupled together for cutting fabric;

a pair of magnets, each of said magnets being coupled to a respective one of said scissors, each of said magnets magnetically engaging a sewing machine when said scissors are positioned on the sewing machine wherein said magnets are configured to inhibit the scissors from falling off the sewing machine;

a pair of grips, each of said grips being coupled to a respective one of said scissors wherein each of said grips is configured to frictionally engage an object when said scissors are closed on the object for transporting the object without cutting the object, each of said grips being spaced apart from each other when said scissors are closed such that neither of said grips impedes said scissors from closing and thusly cutting; and a seam ripper being coupled to a respective one of said grips wherein said seam ripper is configured to rip seams, said seam ripper having an upper surface and a distal end with respect to a distal end of said respective grip, said upper surface tapering to a point between said respective grip and said distal end of said seam ripper wherein said seam ripper is configured to be inserted into a seam, said upper surface being concavely arcuate between said grip and said distal end of said seam ripper such that said seam ripper curves toward said grip to which said ream ripper is opposed, wherein said upper surface has a ridge extending between said distal end of said seam ripper and said grip wherein said ridge is configured to cut thread in the seam for ripping the seam.

5. The assembly according to claim 4, further comprising a ball being coupled to said distal end of said seam ripper wherein said ball is configured to inhibit said distal end of said seam ripper from piercing a user's finger.

6. A sewer's multi-tool assembly having a seam ripper being integrated into a pair of scissors wherein said assembly is configured to be manipulated by a sewer for cutting fabric and for ripping seams, said assembly comprising:

a pair of scissors being hingedly coupled together for cutting fabric, each of said scissors having a first end and a second end, said first end of each of said scissors being pivotally coupled together having said second end of each of said scissors being aligned with each other, said second end of each of said scissors tapering to a point, said second end of each of said scissors being biased away from each other, each of said scissors having a cutting edge extending from said second end toward said first end, said cutting edge on each of said scissors engaging each other when said scissors are closed for cutting the fabric;

a pair of magnets, each of said magnets being coupled to a respective one of said scissors, each of said magnets magnetically engaging a sewing machine when said scissors are positioned on the sewing machine wherein said magnets are configured to inhibit the scissors from falling off the sewing machine;

a pair of grips, each of said grips being coupled to a respective one of said scissors wherein each of said grips is configured to frictionally engage an object when said scissors are closed on the object for transporting the object without cutting the object, each of said grips being spaced apart from each other when said scissors are closed such that neither of said grips impedes said scissors from closing and thusly cutting, each of said grips extending away from said second end of said respective scissor, each of said grips having a distal end with respect to said respective scissor and a top surface, each of said grips being oriented collinear with a longitudinal axis extending through said first and second ends of said respective scissor, said top surface of each of said grips facing each other wherein said grips are configured to compress the object between said top surface of each of said grips when said scissors are closed on the object, said top surface of each of said grips being offset with said cutting edge of said respective scissor, said top surface of each of said grips being spaced apart from each other when said scissors are closed thereby facilitating said cutting edge on each of said scissors to engage each other for cutting;

a seam ripper being coupled to a respective one of said grips wherein said seam ripper is configured to rip seams, said seam ripper having an upper surface and a distal end with respect to said distal end of said respective grip, said upper surface tapering to a point between said respective grip and said distal end of said seam ripper wherein said seam ripper is configured to be inserted into a seam, said upper surface being concavely arcuate between said grip and said distal end of said seam ripper such that said seam ripper curves toward said grip to which said ream ripper is opposed, said upper surface having a ridge extending between said distal end of said seam ripper and said grip wherein said ridge is configured to cut thread in the seam for ripping the seam; and a ball being coupled to said distal end of said seam ripper wherein said ball is configured to inhibit said distal end of said seam ripper from piercing a user's finger.

* * * * *